United States Patent [19]

Dean

[11] 4,107,371

[45] Aug. 15, 1978

[54] WOVEN FABRIC THAT IS RELATIVELY STIFF IN ONE DIRECTION AND RELATIVELY FLEXIBLE IN THE OTHER

[75] Inventor: William Bruce Dean, Cornelia, Ga.

[73] Assignee: Johnson & Johnson, New Brunswick, N.J.

[21] Appl. No.: 844,673

[22] Filed: Oct. 25, 1977

[51] Int. Cl.[2] ..... B32B 7/00

[52] U.S. Cl. ..... 428/255; 139/420 R; 428/257; 428/258; 428/259

[58] Field of Search ..... 428/255, 257, 258, 259, 428/193; 139/420 R

[56] References Cited

U.S. PATENT DOCUMENTS

| | | | |
|---|---|---|---|
| 2,409,089 | 10/1946 | Whitman | 139/420 R |
| 2,745,107 | 5/1956 | Gemignani | 2/236 |
| 2,942,327 | 6/1960 | Corry | 428/258 |
| 3,163,185 | 12/1964 | Stanley et al. | 139/420 R |
| 3,176,820 | 4/1965 | Griffin | 139/420 R |
| 3,317,366 | 5/1967 | Dionne | 139/420 R |
| 3,473,885 | 10/1969 | Stanley | 139/420 R |
| 3,571,814 | 3/1971 | Miller | 2/236 |
| 3,597,300 | 8/1971 | Miller | 428/193 |
| 3,902,536 | 9/1975 | Schmidt | 139/420 R |

*Primary Examiner*—James J. Bell
*Attorney, Agent, or Firm*—Charles J. Metz

[57] ABSTRACT

There is disclosed an open weave fabric that is relatively stiff in the filling direction and relatively flexible in the warp direction. The fabric comprises a plurality of individual, spaced, stiff monofilaments in parallel relationship in the filling direction, and a plurality of groups of at least two substantially parallel strands closely associated in side-by-side relationship in the warp direction, the groups being spaced to provide an open weave mesh pattern therebetween, the strands of each of said groups being arranged one strand over and the next strand under in alternating interlocking relationship at the point of crossing each of the respective individual monofilaments in the filling direction, wherein each of the strands comprises a multi-filament yarn core coated with a thermoplastic polymer sheath, wherein said open weave fabric is stabilized by fusion of said thermoplastic polymer at the point where said strands cross the said individual monofilaments.

7 Claims, 2 Drawing Figures

WOVEN FABRIC THAT IS RELATIVELY STIFF IN ONE DIRECTION AND RELATIVELY FLEXIBLE IN THE OTHER

The invention relates to a woven fabric that is relatively stiff in one direction and relatively flexible in the other.

BACKGROUND OF THE INVENTION

Fabric that is relatively stiff in one direction and relatively flexible in the other, is widely used in the production of apparel. For instance, such fabrics are used in the waist band of trousers to prevent rolling of the fabric at the waist line. Many types of fabrics have been employed for this purpose. For instance, Stanley, in U.S. Pat. Nos. 3,163,185 and 3,473,885, has disclosed such a fabric in which the yarns running in one direction are made of rayon that is fusible by treatment with zinc chloride solution, with the yarns in the other direction being cotton. When such a fabric is treated with zinc chloride solution, the rayon yarns become stiff while the cotton yarns remain relatively unaffected.

In a great many fabrics of this type, natural hair such as horse hair has been used as the stiffening elements. Miller, in U.S. Pat. No. 3,571,814, has disclosed such a fabric having nylon monofilaments in the filling direction with cotton yarn in the other direction. A similar fabric is disclosed by Smith in U.S. Pat. No. 2,298,071, who solves a problem of displacement of the stiffening monofilaments by employing an adhesive or solvent for the monofilament to stabilize the fabric.

This problem of stabilizing such a fabric is addressed by a number of prior art patents. For instance, Gemignani, in U.S. Pat. No. 2,745,107, prevents migration of the stiffening monofilaments by longitudinally folding the fabric. Other workers have used a plastic bead to prevent monofilaments from loosening from a fabric. An illustration is Miller, in U.S. Pat. No. 3,597,300.

BRIEF DESCRIPTION OF THE INVENTION

The invention provides a fabric that is relatively stiff in one direction and relatively flexible in the other, wherein the stiffening elements are locked in place and cannot become unraveled. The fabric of the invention is an open weave fabric having a plurality of individual, spaced, stiff monofilaments in parallel relationship in the filling direction, and a plurality of groups of at least two substantially parallel strands closely associated in side-by-side relationship in the warp direction, said groups being spaced to provide an open weave mesh pattern therebetween, with the strands of each of said groups being arranged one strand over and the next strand under in alternating interlocking relationship at the point of crossing each of the respective individual monofilaments, wherein each of said strands comprises a multi-filament yarn core coated with a thermoplastic polymer sheath, wherein the open weave fabric is stabilized by fusion of said thermoplastic polymer at the points where said strands cross the said individual monofilaments.

DETAILED DESCRIPTION OF THE INVENTION

Figure 1:
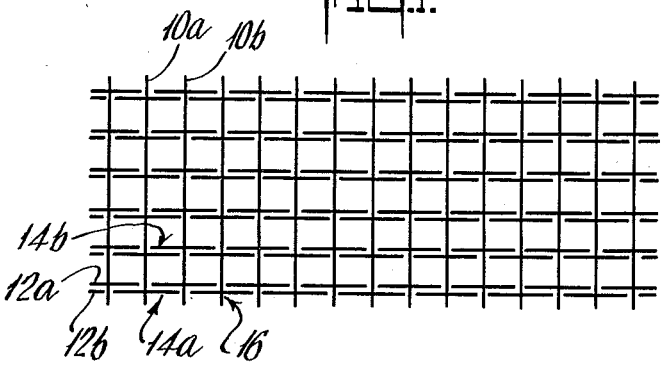
FIG. 1 is a schematic view of a portion of a fabric constructed in accordance with the invention.
Figure 2:
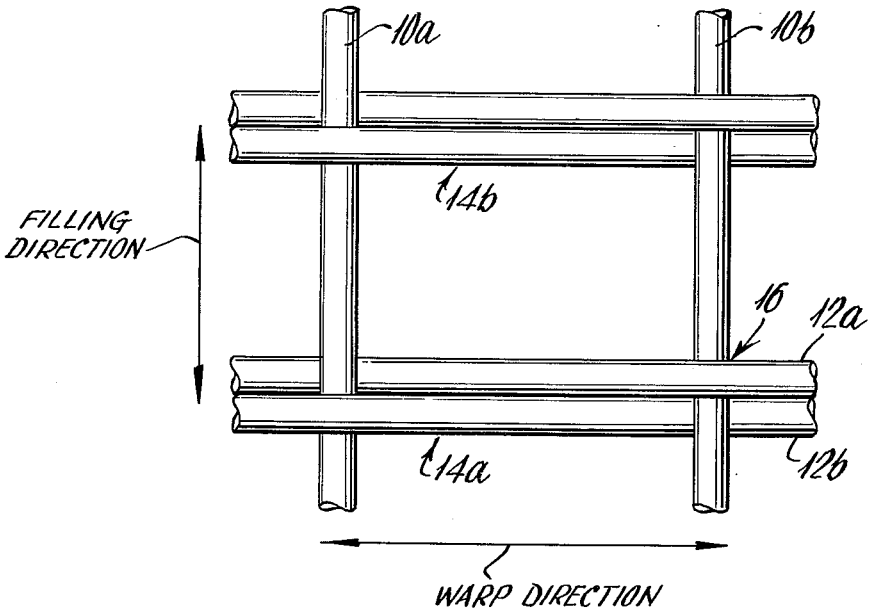
FIG. 2 is a greatly enlarged view of a portion of the fabric shown in FIG. 1.

Referring to the drawings, there is shown a fabric embodying the principles of the invention. The fabric has parallel monofilaments 10*a*, 10*b* running in the filling direction. Said monofilaments 10*a*, 10*b* are made of a heavy denier material that is relatively stiff. The warp yarns 12*a*, 12*b* are arranged in parallel groups 14*a*, 14*b* or sets of two yarns. The warp yarns 12*a*, 12*b* in each group 14*a*, 14*b* are in closely spaced, side-by-side relationship, and are arranged one strand over and the next strand under in alternating interlocking relationship at the point 16 of crossing the monofilaments 10*a*, 10*b*. The groups 14*a*, 14*b* are spaced apart such that the fabric has an open weave construction.

The yarns 12*a*, 12*b* running in the warp direction have a multi-filament core, such as polyester yarn, and are coated with a thermoplastic polymer, such as plasticized polyvinyl chloride. Such plastic-coated yarns are known.

As a rule, there will be about 8 to about 24 ends per inch in the filling direction, and about 22 to about 38 picks per inch in the warp direction.

The monofilaments employed in the filling direction for stiffening are typically nylon 66 having a denier of about 333 to about 1500. The fabric construction will employ, for instance, 22 to 38 monofilaments per inch. Within the ranges of denier and spacing, a wide range of flexibility or stiffness can be obtained. Stiffness is directly proportional to the denier and to the number of monofilaments per inch. Other types of monofilament, such as high density polyethylene, can also be used, but nylon is preferred because of its resiliency.

The warp yarns employed are plastic-coated yarns. The coated yarns will ordinarily have diameters of from about 11 to about 25 mils, of which about 25–27 percent (by weight) is the central yarn core, with the balance being the plastic sheath. The yarn core can be polyester, cotton, rayon, or the like. The plastic sheath can be plasticized vinyl chloride polymer (either homopolymer or copolymer with vinyl acetate), polypropylene, or the like.

The fabric will usually be constructed such that it will have from about 8 to 24 coated yarns per inch, arranged in groups of two or more, e.g., in groups of 2–4.

The fabric is produced by a conventional weaving operation. After weaving, the fabric of the invention is subjected to a temperature sufficient to cause the polymeric coating of the yarns to flow and thereby interlock and stabilize the fabric. The conditions required for this operation will vary somewhat, depending on the nature and size of the coated warp yarns. Typical conditions for a plasticized polyvinyl chloride-coated yarn are about 415° to 425° F. for about 20 seconds.

The following example illustrates the principles of the invention:

EXAMPLE

A fabric whose construction is illustrated in the drawings was produced. The monofilaments running in the filling direction was nylon 66 having a denier of 1100. The spacing was 28 picks per inch.

The warp yarns were plasticized polyvinyl chloride-coated polyester yarns, arranged in groups of two as shown in the drawings. The core was 150 denier polyester yarn, and the coated yarn had a diameter of about 11 mils. There were 20 warp yarns per inch.

The woven fabric was run through a tentering oven under conditions such that it was heated to 415° – 425° F. for about 20 seconds. The resulting fabric was quite stiff and resilient in the filling direction, flexible in the warp direction and quite stable such that under ordinary use conditions the stiffening monofilaments could not work loose.

What is claimed is:

1. An open weave fabric that is relatively stiff in the filling direction and relatively flexible in the warp direction, said fabric comprising (a) a plurality of individual, spaced, stiff monofilaments in parallel relationship in the filling direction, and (b) a plurality of groups of at least two substantially parallel strands closely associated in side-by-side relationship in the warp direction, said groups being spaced to provide an open weave mesh pattern therebetween, the strands of each of said groups being arranged one strand over and the next strand under in alternating interlocking relationship at the point of crossing each of the respective individual monofilaments in the filling direction, wherein each of said strands comprises a multi-filament yarn core coated with a thermoplastic polymer sheath, and wherein said open weave fabric is stabilized by fusion of said thermoplastic polymer at the point where said strands cross the said individual monofilaments.

2. The fabric of claim 1 wherein said monofilaments are nylon and wherein said strands are multi-filament polyester yarns coated with plasticized vinyl chloride polymer.

3. The fabric of claim 1 wherein each of said groups is composed of two of said strands.

4. The fabric of claim 1 wherein there are from about 22 to about 38 monofilaments per inch and about 8 to about 24 strands per inch.

5. The fabric of claim 4 wherein the monofilaments have a denier of from about 333 to about 1500, and wherein the diameter of the strands is from about 11 to about 25 mils.

6. The fabric of claim 5 wherein the monofilaments are nylon and the strands are multi-filament polyester yarns coated with plasticized vinyl chloride polymer.

7. The fabric of claim 1 wherein each of said groups is composed of from two to four of said strands.

* * * * *